US008360023B2

(12) United States Patent
Hendriksma

(10) Patent No.: US 8,360,023 B2
(45) Date of Patent: Jan. 29, 2013

(54) ENGINE INCLUDING VALVE LIFT MECHANISM WITH OIL FLOW CONTROL FEATURES

(75) Inventor: Nick John Hendriksma, Grand Rapids, MI (US)

(73) Assignee: GM Global Technologies Operations LLC

( * ) Notice: Subject to any disclaimer, the term of this patent is extended or adjusted under 35 U.S.C. 154(b) by 241 days.

(21) Appl. No.: 12/858,729

(22) Filed: Aug. 18, 2010

(65) Prior Publication Data

US 2012/0042842 A1 Feb. 23, 2012

(51) Int. Cl.
*F01L 1/34* (2006.01)

(52) U.S. Cl. ..... 123/90.48; 123/90.16; 123/90.43

(58) Field of Classification Search ..... 123/90.48, 123/90.52, 90.43, 90.16
See application file for complete search history.

(56) References Cited

U.S. PATENT DOCUMENTS 4,607,599 A * 8/1986 Buente et al. ..... 123/90.5
4,739,675 A * 4/1988 Connell ..... 74/569
4,913,106 A * 4/1990 Rhoads ..... 123/90.49
6,513,470 B1 2/2003 Hendriksma et al.
2005/0103300 A1* 5/2005 Spath et al. ..... 123/90.59

OTHER PUBLICATIONS

Kuiper, Dan B., "Variables Affecting Hydraulic Valve Lifter Performance," Diesel Equipment Division and General Motors Institute, Grand Rapids, MI, Jul. 15, 1956, pp. 138-182.
Moroney, Richard M. et al., "A Passive Fluid Valve Element for a High-density Chemical Synthesis Machine," Sarnoff Corporation, CN-5300, Princeton, NJ 08543, 4 pgs.

* cited by examiner

*Primary Examiner* — Zelalem Eshete
(74) *Attorney, Agent, or Firm* — Harness, Dickey & Pierce, P.L.C.

(57) ABSTRACT

A valve lift mechanism may include a housing member and a plunger. The housing member may define a first annular wall including a first oil passage. An inner circumference of the first annular wall may define a first continuous region along an axial extent corresponding to the first oil passage from a first location on the inner circumference and circumferentially offset from the first oil passage to a second location on the inner circumference. The plunger may be located within the housing member within the first annular wall. The plunger may define a second annular wall including a series of apertures axially aligned with the first oil passage and separated from one another by an outer circumferential region of the second annular wall. The outer circumferential region may abut the first continuous region of the first annular wall to inhibit oil flow past the outer circumferential region.

20 Claims, 4 Drawing Sheets

ENGINE INCLUDING VALVE LIFT MECHANISM WITH OIL FLOW CONTROL FEATURES

FIELD

The present disclosure relates to internal combustion engines including valve lift mechanisms.

BACKGROUND

This section provides background information related to the present disclosure which is not necessarily prior art.

Engine assemblies may include valve lift mechanisms engaged with a camshaft to provide opening of intake and exhaust valves during engine operation. The valve lift mechanisms may include hydraulic lash adjusters to maintain engagement with valvetrain components such as pushrods during operation. However, due to the arrangement of oil flow paths to the valve lift mechanisms and internal to the valve lift mechanisms, oil may drain from the hydraulic lash adjusters during operation.

SUMMARY

An engine assembly may include an engine structure, a camshaft, and a valve lift mechanism. The engine structure may define a cylinder bore and a lifter housing. The camshaft may be rotationally supported by the engine structure and the valve lift mechanism may be located within the first lifter housing and engaged with a first lobe of the camshaft.

The valve lift mechanism may include a housing member and a plunger. The housing member may define a first annular wall including a first oil passage extending therethrough. An inner circumference of the first annular wall may define a first continuous region along an axial extent corresponding to the first oil passage from a first location on the inner circumference and circumferentially offset from the first oil passage to a second location on the inner circumference at least one hundred and eighty degrees circumferentially offset from the first location. The plunger may be located within the housing member within the first annular wall. The plunger may define a second annular wall including a series of apertures axially aligned with at least a portion of the first oil passage and separated from one another by an outer circumferential region of the second annular wall. The outer circumferential region may abut the first continuous region of the first annular wall to inhibit oil flow past the outer circumferential region.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
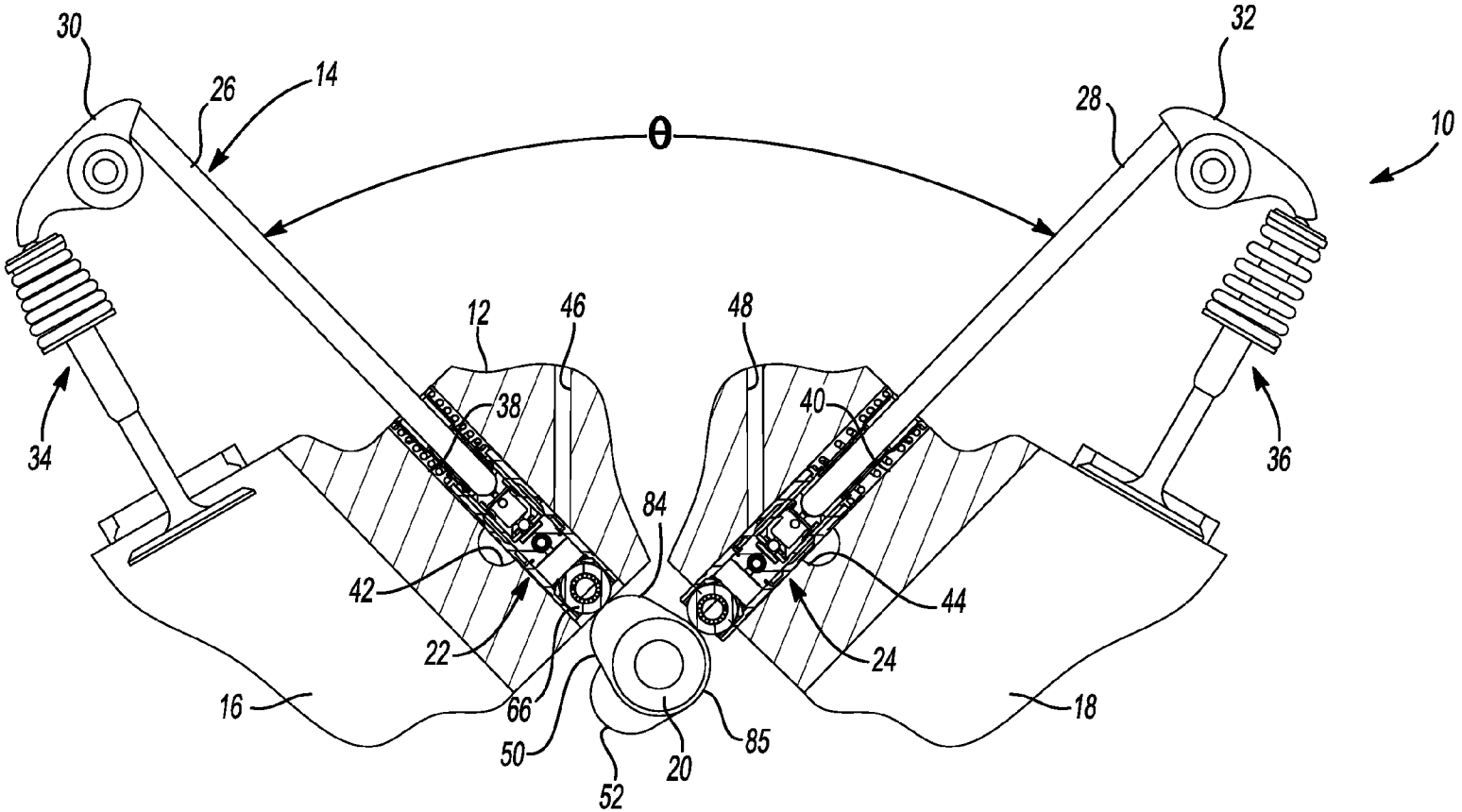
FIG. 1 is a schematic section view of an engine assembly according to the present disclosure.
Figure 2:
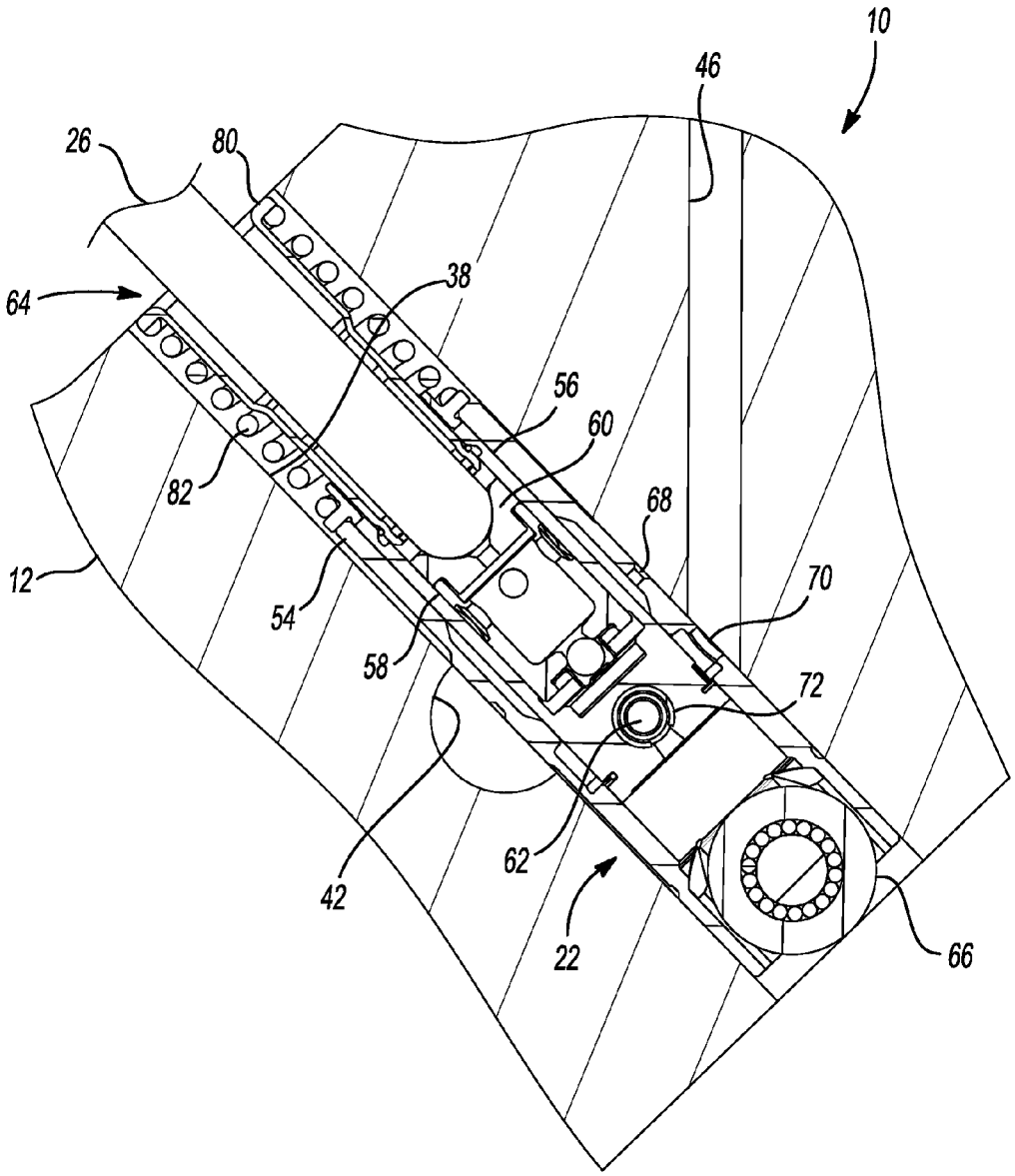
FIG. 2 is an enlarged portion of the section view of FIG. 1.

With reference to FIGS. 1 and 2, an internal combustion engine assembly 10 may include an engine structure 12 and a valvetrain assembly 14. The engine structure 12 may define first and second cylinder bores 16, 18 disposed at an angle relative to one another to form a V-configuration. While illustrated and described as a V-engine with a cam-in-block arrangement, it is understood that the present disclosure may have additional applications to inline engines and overhead camshaft arrangements. While first and second cylinder bores 16, 18 are illustrated, the present disclosure applies to engines having any number of cylinder bores.

The valvetrain assembly 14 may include a camshaft 20 rotationally supported by the engine structure 12, first and second valve lift mechanisms 22, 24, first and second pushrods 26, 28, first and second rocker arms 30, 32 and first and second valve assemblies 34, 36. The engine structure 12 may define first and second lifter housings 38, 40. The first valve lift mechanism 22 may be located within the first lifter housing 38 and extend along the first cylinder bore 16. The engine structure 12 may define first and second oil passages 42, 44 in communication with the first lifter housing 38. The second valve lift mechanism 24 may be located within the second lifter housing 40 and extend along the second cylinder bore 18. The engine structure 12 may additionally define third and fourth oil passages 46, 48 in communication with the second lifter housing 40. By way of non-limiting example, the second valve lift mechanism 24 may be disposed at an angle (θ) of at least forty-five degrees relative to the first valve lift mechanism 22, and more specifically at an angle (θ) of at least sixty degrees relative to the first valve lift mechanism 22.

The first pushrod 26 may be engaged with the first valve lift mechanism 22 and the first rocker arm 30. The first rocker arm 30 may be engaged with the first valve assembly 34 and may displace the first valve assembly 34 between opened and closed positions based on displacement of the first valve lift mechanism 22. The second pushrod 28 may be engaged with the second valve lift mechanism 24 and the second rocker arm 32. The second rocker arm 32 may be engaged with the second valve assembly 36 and may displace the second valve assembly 36 between opened and closed positions based on displacement of the second valve lift mechanism 24.

The first valve lift mechanism 22 may be engaged with a first lobe 50 on the camshaft 20 and the second valve lift mechanism 24 may be engaged with a second lobe 52 on the camshaft 20. The first and second valve lift mechanisms 22, 24 may be similar to one another. Therefore, for simplicity, the first valve lift mechanism 22 will be described with the understanding that the description applies equally to the second valve lift mechanism 24.

The first valve lift mechanism 22 may include a lifter body 54, a housing member 56, a plunger 58, a pushrod seat 60 engaged with the first pushrod 26, a locking mechanism 62, a lost motion mechanism 64 and a cam follower 66 coupled to the lifter body 54. The lifter body 54 may be located in the first lifter housing 38 and may include a first opening 68 in communication with the first oil passage 42 and a second opening 70 in communication with the second oil passage 44. The first opening 68 may provide pressurized oil flow to the plunger 58 and the plunger 58 may form a hydraulic lash adjuster to maintain engagement between the first pushrod 26 and the pushrod seat 60.

The housing member 56 may form a lock pin housing defining an opening 72 containing the locking mechanism 62 therein. While described in combination with a deactivating lift mechanism, it is understood that the present disclosure applies equally to a variety of other switchable valve lift mechanisms as well as fixed lift mechanisms (i.e., non-switchable valve lift mechanisms). The locking mechanism 62 may include first and second locking pins and a biasing member (not shown). The biasing member may force the locking pins radially outward from one another.

The first and second locking pins may be displaceable between locked and unlocked positions by selectively providing pressurized oil to the second oil passage 44. In the locked position (FIG. 1), the first and second locking pins fix the first pushrod 26 for displacement with the lifter body 54. In the unlocked position (not shown), the first and second locking pins allow relative displacement between the first pushrod 26 and the lifter body 54.

The lost motion mechanism 64 may include a retaining member 80 and a biasing member 82. The retaining member 80 may be axially fixed to the housing member 56 and the biasing member 82 may engage the retaining member 80 and the lifter body 54, biasing the cam follower 66 into engagement with the first lobe 50 of the camshaft 20. The first lobe 50 may displace the lifter body 54 toward the retaining member 80 against the force of the biasing member 82 as a peak 84 of the first lobe 50 engages the cam follower 66. The lifter body 54 may be returned to an initial position by the biasing member 82 as a base region 85 of the first lobe 50 engages the cam follower 66.

When the first and second locking pins are in the locked position, the first lobe 50 of the camshaft 20 may displace the housing member 56, and therefore the first pushrod 26, with the housing member 56 (as seen in FIG. 1) to open the first valve assembly 34 based on an engagement between the peak 84 of the first lobe 50 and the cam follower 66. When the first and second locking pins are in the unlocked position (not shown), the lifter body 54 may be displaced relative to the housing member 56 when the cam follower 66 is engaged with the peak 84 of the first lobe 50, preventing opening of the first valve assembly 34.

Figure 3:
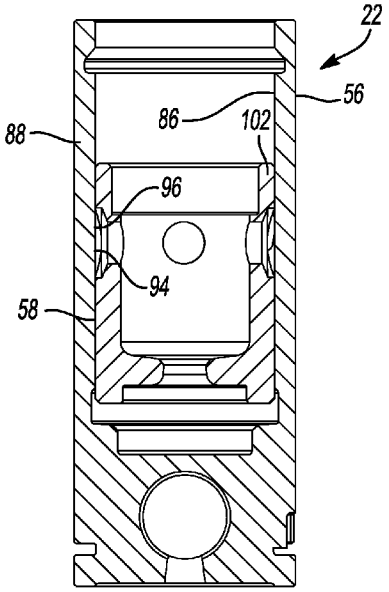
FIG. 3 is a section view of a portion of the valve lift mechanism shown in FIG. 1.
Figure 4:
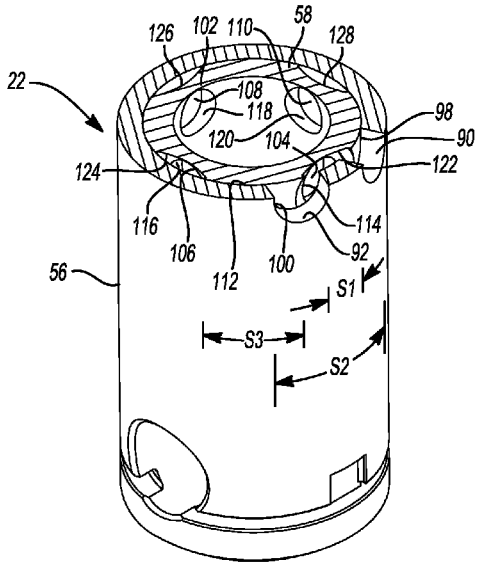
FIG. 4 is a perspective section view of the portion of the valve lift mechanism shown in FIG. 3.

With additional reference to FIGS. 3 and 4, the housing member 56 may include a recess 86 defined by a first annular wall 88. The first annular wall 88 may include first and second oil passages 90, 92 extending therethrough. An inner circumference 94 of the first annular wall 88 may define a first continuous region 96 along an axial extent corresponding to the first oil passage 90 and the second oil passage 92 from a first location 98 on the inner circumference 94 and circumferentially offset from the first oil passage 90 to a second location 100 on the inner circumference 94 at least one hundred and eighty degrees circumferentially offset from the first location 98.

A circumferentially outermost portion of the first oil passage 90 relative to the second oil passage 92 may define the first location 98 and a circumferentially outermost portion of the second oil passage 92 relative to the first oil passage 90 may define the second location 100. The first oil passage 90 and the second oil passage 92 may face the second cylinder bore 18. A first circumferential spacing (S1) may be defined between circumferentially innermost adjacent portions of the first and second oil passages 90, 92 and a second circumferential spacing (S2) may be defined between circumferentially outermost portions of the first and second oil passages 90, 92.

The plunger 58 may be located in the recess 86 of the housing member 56. The plunger 58 may define a second annular wall 102 including a series of apertures 104, 106, 108, 110 axially aligned with at least a portion of the first oil passage 90 and the second oil passage 92. The apertures 104, 106, 108, 110 may be separated from one another by an outer circumferential region 112 of the second annular wall 102. The apertures 104, 106, 108, 110 may be evenly spaced from one another.

In the non-limiting example shown in FIGS. 3 and 4, each of the apertures 104, 106, 108, 110 may include a passage 114, 116, 118, 120 extending through the second annular wall 102 and surrounded by a recessed region 122, 124, 126, 128. The recessed regions 122, 124, 126, 128 may each extend radially inward relative to the outer circumferential region 112 of the second annular wall 102. Each of the recessed regions 122, 124, 126, 128 may define an arcuate shape.

The outer circumferential region 112 may abut the first continuous region 96 of the first annular wall 88 to inhibit oil flow past the outer circumferential region 112. The outer circumferential region 112 abutting the first continuous region 96 of the first annular wall 88 may include a radial clearance between the outer circumferential region 112 and the first continuous region 96 of less than ten microns.

At least one of the apertures 104, 106, 108, 110 may be circumferentially aligned with at least a portion of the first oil passage 90 irrespective of the rotational orientation of the plunger 58 within the housing member 56. By way of non-limiting example, a first of the apertures (e.g., aperture 104) in the plunger 58 may be circumferentially aligned with at least a portion of the first oil passage 90 and a second of the apertures (e.g., aperture 106) in the plunger 58 may be isolated from the first oil passage 90 by the first continuous region 96 of the first annular wall 88 and the outer circumferential region 112 of the second annular wall abutting one another. A circumferential extent (S3) defined by the outer circumferential region 112 of the second annular wall 102 may be greater than the first circumferential spacing (S1) and less than the second circumferential spacing (S2).

Figure 5:
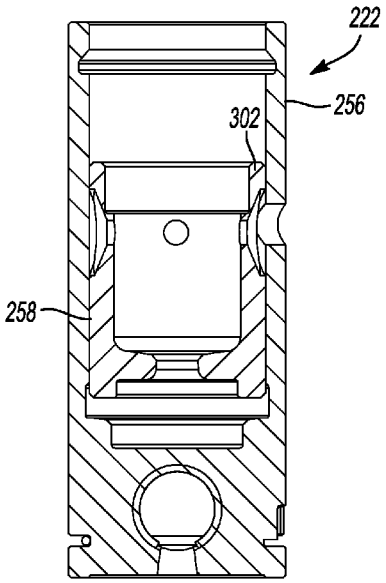
FIG. 5 is a section view of a portion of an alternate valve lift mechanism according to the present disclosure.
Figure 6:
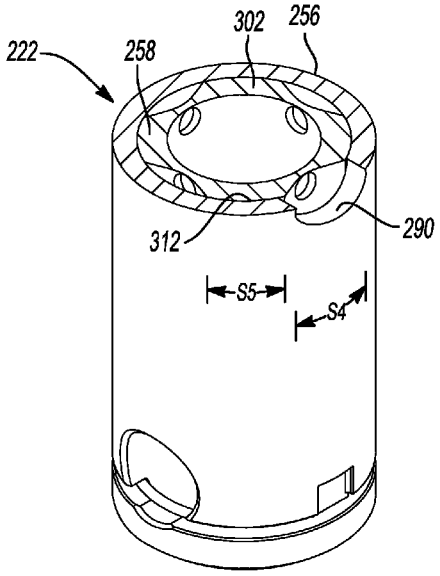
FIG. 6 is a perspective section view of the portion of the valve lift mechanism shown in FIG. 5.

In another arrangement illustrated in FIGS. 5 and 6, a valve lift mechanism 222 may be used in place of the first valve lift mechanism 22. The valve lift mechanism 222 may be generally similar to the first valve lift mechanism 22, with the exceptions noted. The valve lift mechanism 222 may include a housing member 256 and a plunger 258 similar to the housing member 56 and plunger 58 discussed above. However, the housing member 256 may include a single oil passage 290. The oil passage 290 may define a maximum circumferential extent (S4) that is greater than a circumferential extent (S5) defined by the outer circumferential region 312 of the second annular wall 302 of the plunger 258.

Figure 7:
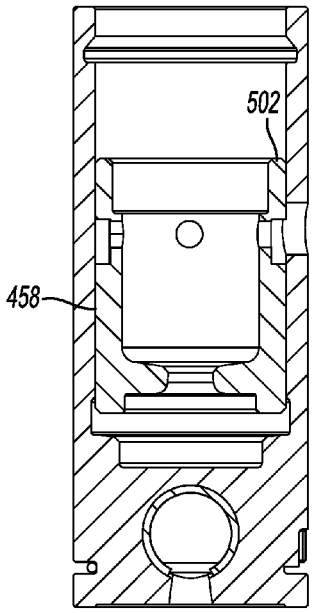
FIG. 7 is a section view of a portion of an alternate valve lift mechanism according to the present disclosure.
Figure 8:
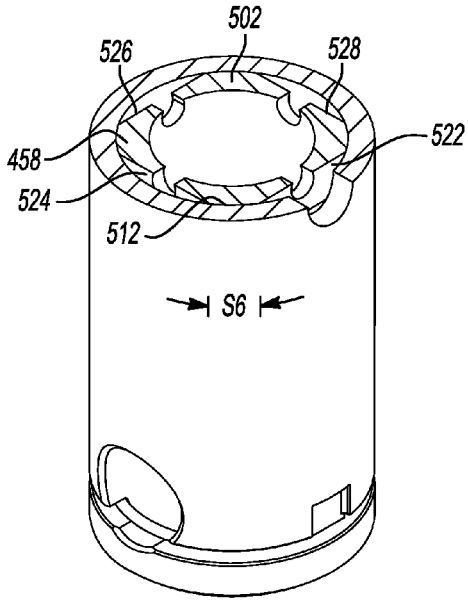
FIG. 8 is a perspective section view of the portion of the valve lift mechanism shown in FIG. 7.

In another arrangement illustrated in FIGS. 7 and 8, a plunger 458 may include flats 522, 524, 526, 528 in place of the arcuate shape shown for the recessed regions 122, 124, 126, 128 in FIGS. 3 and 4. The plunger 458 may be used in place of the plunger 58 for the valve lift mechanism 22 shown in FIGS. 3 and 4 or in place of the plunger 258 for the valve lift mechanism 222 shown in FIGS. 5 and 6. The circumferential extent (S6) defined by the outer circumferential region 512 of the second annular wall 502 may be sized similar to the circumferential extent (S3) when used in an arrangement similar to the valve lift mechanism 22 shown in FIGS. 3 and 4. The circumferential extent (S6) may be sized similar to the circumferential extent (S5) when used in an arrangement similar to the valve lift mechanism 222 shown in FIGS. 5 and 6.

Figure 9:
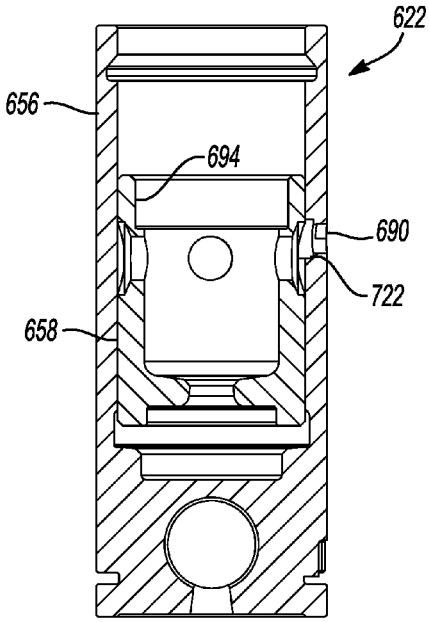
FIG. 9 is a section view of a portion of an alternate valve lift mechanism according to the present disclosure.
Figure 10:
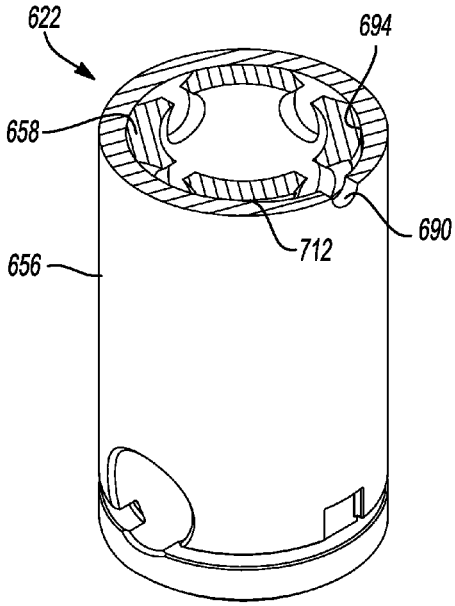
FIG. 10 is a perspective section view of the portion of the valve lift mechanism shown in FIG. 9.

In yet another arrangement, a valve lift mechanism 622 illustrated in FIGS. 9 and 10 may be used in place of the first valve lift mechanism 22. The valve lift mechanism 622 may be generally similar to the first valve lift mechanism 22, with the exceptions noted. The valve lift mechanism 622 may include a housing member 656 and a plunger 658. However, instead of having recessed regions 122, 124, 126, 128 extending radially into the outer circumferential region 712 of the plunger 658, a recess (or scallop) 722 may extend radially into the inner circumference 694 of the housing member 656 at the oil passage 690. While a single oil passage 690 is illustrated (similar to the arrangements of FIGS. 5-8), it is understood that a similar arrangement may be applied to housing members having multiple oil passages (similar to the arrangement of FIGS. 3 and 4).

What is claimed is:

1. An engine assembly comprising:

an engine structure defining a first cylinder bore and a first lifter housing;

a camshaft rotationally supported by the engine structure; and a first valve lift mechanism located within the first lifter housing, engaged with a first lobe of the camshaft and including:

a housing member defining a first annular wall including a first oil passage extending therethrough, an inner circumference of the first annular wall defining a first continuous region along an axial extent corresponding to the first oil passage from a first location on the inner circumference to a second location on the inner circumference at least 180 degrees circumferentially offset from the first location; and a plunger located in the housing member within the first annular wall, the plunger defining a second annular wall including a series of apertures axially aligned with at least a portion of the first oil passage and separated from one another by an outer circumferential region of the second annular wall, the outer circumferential region abutting the first continuous region of the first annular wall to inhibit oil flow past the outer circumferential region.

2. The engine assembly of claim 1, wherein first valve lift mechanism includes a lifter body located within the lifter housing and a locking mechanism coupled to the housing member, the locking mechanism being displaceable between locked and unlocked positions, the housing member being axially displaceable relative to the lifter body when the locking mechanism is in the unlocked position and being fixed for axial displacement with the lifter body when the locking mechanism is in the locked position.

3. The engine assembly of claim 1, wherein the engine structure defines first and second cylinder bores extending at an angle relative to one another to form a V-configuration, the first valve lift mechanism extending along the first cylinder bore and the first oil passage facing the second cylinder bore.

4. The engine assembly of claim 3, further comprising a second lift mechanism extending along the second cylinder bore, located within a second lifter housing defined by the engine structure, and extending along the second cylinder bore at an angle of at least 45 degrees relative to the first valve lift mechanism.

5. The engine assembly of claim 1, wherein the outer circumferential region abutting the first continuous region of the first annular wall to inhibit oil flow past the outer circumferential region includes a radial clearance between the outer circumferential region and the first continuous region of less than 10 microns.

6. The engine assembly of claim 1, wherein a first of the apertures in the plunger is circumferentially aligned with at least a portion of the first oil passage.

7. The engine assembly of claim 6, wherein a second of the apertures in the plunger is isolated from the first oil passage by the first continuous region of the first annular wall and the outer circumferential region of the second annular wall abutting one another.

8. The engine assembly of claim 1, wherein at least one of the apertures is circumferentially aligned with at least a portion of the first oil passage irrespective of the rotational orientation of the plunger within the housing member.

9. The engine assembly of claim 1, wherein the housing member defines a second oil passage extending through the first annular wall, the first and second oil passages defining a first circumferential spacing between circumferentially innermost adjacent portions thereof and defining a second circumferential spacing between circumferentially outermost portions thereof, a circumferential extent defined by the outer circumferential region of the second annular wall being greater than the first circumferential spacing and less than the second circumferential spacing.

10. The engine assembly of claim 1, wherein a first of the apertures includes a passage extending through the second annular wall and a recessed region surrounding the passage and extending radially inward relative to the outer circumferential region of the second annular wall.

11. The engine assembly of claim 1, wherein a circumferential extent defined by the outer circumferential region of the plunger between adjacent ones of the apertures is less than a circumferential extent of the first oil passage in the housing member.

12. A valve lift mechanism comprising:

a housing member defining a first annular wall including a first oil passage extending therethrough, an inner circumference of the first annular wall defining a first continuous region along an axial extent corresponding to the first oil passage from a first location on the inner circumference to a second location on the inner circumference at least 180 degrees circumferentially offset from the first location; and a plunger located in the housing member within the first annular wall, the plunger defining a second annular wall including a series of apertures axially aligned with at least a portion of the first oil passage and separated from one another by an outer circumferential region of the second annular wall, the outer circumferential region abutting the first continuous region of the first annular wall to inhibit oil flow past the outer circumferential region.

13. The valve lift mechanism of claim 12, further comprising a lifter body located within the lifter housing and a locking mechanism coupled to the housing member, the locking mechanism being displaceable between locked and unlocked positions, the housing member being axially displaceable relative to the lifter body when the locking mechanism is in the unlocked position and being fixed for axial displacement with the lifter body when the locking mechanism is in the locked position.

14. The valve lift mechanism of claim 12, wherein the outer circumferential region abutting the first continuous region of the first annular wall to inhibit oil flow past the outer circumferential region includes a radial clearance between the outer circumferential region and the first continuous region of less than 10 microns.

15. The valve lift mechanism of claim 12, wherein a first of the apertures in the plunger is circumferentially aligned with at least a portion of the first oil passage.

16. The valve lift mechanism of claim 15, wherein a second of the apertures in the plunger is isolated from the first oil passage by the first continuous region of the first annular wall and the outer circumferential region of the second annular wall abutting one another.

17. The valve lift mechanism of claim 12, wherein at least one of the apertures is circumferentially aligned with at least a portion of the first oil passage irrespective of the rotational orientation of the plunger within the housing member.

18. The valve lift mechanism of claim 12, wherein the housing member defines a second oil passage extending through the first annular wall, the first and second oil passages defining a first circumferential spacing between circumferentially innermost adjacent portions thereof and defining a second circumferential spacing between circumferentially outermost portions thereof, a circumferential extent defined by the outer circumferential region of the second annular wall being greater than the first circumferential spacing and less than the second circumferential spacing.

19. The valve lift mechanism of claim 12, wherein a first of the apertures includes a passage extending through the second annular wall and a recessed region surrounding the passage and extending radially inward relative to the outer circumferential region of the second annular wall.

20. The valve lift mechanism of claim 12, wherein a circumferential extent defined by the outer circumferential region of the plunger between adjacent ones of the apertures is less than a circumferential extent of the first oil passage in the housing member.

* * * * *